US005697729A

United States Patent [19]

Bowman

[11] Patent Number: 5,697,729

[45] Date of Patent: Dec. 16, 1997

[54] ANCHOR FOR UTILITY ACCESS HOLE SUPPORT INSERT

[76] Inventor: Harold M. Bowman, 18867 N. Valley Dr., Fairview Park, Ohio 44126

[21] Appl. No.: 517,081

[22] Filed: Aug. 21, 1995

Related U.S. Application Data

[63] Continuation of Ser. No. 242,015, May 12, 1994, abandoned, which is a continuation-in-part of Ser. No. 87,171, Jul. 2, 1993, abandoned.

[51] Int. Cl.[6] ..... E02D 29/14

[52] U.S. Cl. ..... 404/25; 52/20

[58] Field of Search ..... 404/25, 26; 52/19, 52/20, 21, 22; 49/41, 386; 411/301, 302, 903

[56] References Cited

U.S. PATENT DOCUMENTS

| | | |
|---|---|---|
| Re. 34,550 | 2/1994 | Bowman . |
| D. 247,254 | 2/1978 | Braun et al. . |
| 911,256 | 2/1909 | McWane . |
| 922,892 | 5/1909 | Harrington . |
| 953,858 | 4/1910 | Rice et al. . |
| 1,001,041 | 8/1911 | Jones . |
| 1,016,081 | 1/1912 | McNulty . |
| 1,071,577 | 8/1913 | Rego . |
| 1,073,150 | 9/1913 | Linskie . |
| 1,102,422 | 7/1914 | McKeon . |
| 1,131,327 | 3/1915 | Caldwell . |
| 1,152,618 | 9/1915 | Farris . |
| 1,163,189 | 12/1915 | Wolf . |
| 1,177,850 | 4/1916 | Dougherty . |
| 1,191,431 | 7/1916 | Jones . |
| 1,191,432 | 7/1916 | Jones . |
| 1,191,497 | 7/1916 | Dauphinee . |
| 1,287,290 | 12/1918 | Golden . |
| 1,384,712 | 7/1921 | Shanley . |
| 1,388,492 | 8/1921 | Thomsen . |
| 1,400,399 | 12/1921 | Yaeche . |
| 1,417,377 | 5/1922 | Gschwind . |
| 1,542,900 | 6/1925 | Maddocks . |
| 1,602,713 | 10/1926 | Shanley . |
| 1,610,123 | 12/1926 | Fairweather . |
| 1,683,365 | 9/1928 | Loudenslager et al. . |
| 1,693,190 | 11/1928 | Benedetti . |
| 1,717,364 | 6/1929 | Borland . |
| 1,721,831 | 7/1929 | Porter . |
| 1,892,830 | 1/1933 | Dougherty . |
| 1,898,871 | 2/1933 | Ellis . |
| 1,926,595 | 9/1933 | Mulvihill . |

(List continued on next page.)

OTHER PUBLICATIONS

Drawing from New York State's Department of Transportation date unknown.

P.C. Perdikaris, P.E., Ph.D., Technical Civil Engineering Report, Mar. 15, 1988.

Japanese publication entitled "Reinforced Concrete Manhole Blocks For Sewage Work", by Japanese Standards Association, published 1990.

Japanese publication entitled "Manhole Cover For Sewage", by Japanese Standards Association, published 1987.

NUPCO brochure, "Adjus–To–Grate With Safe–Tite Seal", Copyright 1989.

*Primary Examiner*—James Lisehora

*Attorney, Agent, or Firm*—Watts, Hoffmann, Fisher & Heinke

[57] ABSTRACT

A locking device for securing a manhole cover support insert or a grate cover support insert to a utility access frame is disclosed. The locking device includes a plurality of rotatable locking members which are connected to the support insert. The locking members are rotatable between a position where they rest inside the perimeter of the utility access hole and a locking position outside the perimeter of the utility access hole. The locking members may be rotated from an easy to reach position above the utility access hole by turning the exposed head of a bolt. The locking members are stopped from rotating at their locking position by engagement with a stop. From their locking position, the locking members may be axially moved by further rotation of the bolt to lock the support to the frame.

15 Claims, 6 Drawing Sheets

U.S. PATENT DOCUMENTS

| | | | |
|---|---|---|---|
| 1,959,171 | 5/1934 | Mayer . | |
| 1,962,881 | 6/1934 | Shanley . | |
| 1,988,360 | 1/1935 | Moore . | |
| 2,009,132 | 7/1935 | Gehris . | |
| 2,051,172 | 8/1936 | Kramer . | |
| 2,109,287 | 2/1938 | Elkington . | |
| 2,113,713 | 4/1938 | Slocum . | |
| 2,114,499 | 4/1938 | Maclear . | |
| 2,535,275 | 12/1950 | Dixon . | |
| 2,682,211 | 6/1954 | Avila . | |
| 2,697,389 | 12/1954 | Heckman . | |
| 2,817,274 | 12/1957 | Benoit . | |
| 3,217,619 | 11/1965 | Driver et al. . | |
| 3,408,778 | 11/1968 | Mason . | |
| 3,426,659 | 2/1969 | Clarke et al. . | |
| 3,568,746 | 3/1971 | Faroni | 411/302 |
| 3,773,428 | 11/1973 | Bowman . | |
| 3,858,998 | 1/1975 | Larson et al. . | |
| 3,920,347 | 11/1975 | Sauriol et al. . | |
| 3,921,494 | 11/1975 | Coe . | |
| 3,926,533 | 12/1975 | Binette . | |
| 3,930,739 | 1/1976 | Larsson et al. . | |
| 3,945,746 | 3/1976 | Bredbenner . | |
| 3,969,847 | 7/1976 | Campagna et al. . | |
| 3,973,856 | 8/1976 | Gaglioti | 404/25 |
| 3,977,124 | 8/1976 | Oger . | |
| 4,000,953 | 1/1977 | Langeliers et al. . | |
| 4,015,373 | 4/1977 | Boissier . | |
| 4,029,425 | 6/1977 | Pelsue . | |
| 4,030,851 | 6/1977 | Graybeal . | |
| 4,038,789 | 8/1977 | Axgarde et al. . | |
| 4,061,434 | 12/1977 | Carroll . | |
| 4,067,659 | 1/1978 | Campagna, Jr. et al. . | |
| 4,075,796 | 2/1978 | Cuozzo . | |
| 4,089,139 | 5/1978 | Moffa et al. . | |
| 4,097,228 | 6/1978 | Rosling . | |
| 4,123,184 | 10/1978 | Whitlock . | |
| 4,145,151 | 3/1979 | Helms . | |
| 4,187,647 | 2/1980 | Hall . | |
| 4,188,151 | 2/1980 | Hall . | |
| 4,197,031 | 4/1980 | Hild . | |
| 4,203,686 | 5/1980 | Bowman . | |
| 4,273,467 | 6/1981 | Cronk . | |
| 4,281,944 | 8/1981 | Bowman . | |
| 4,416,400 | 11/1983 | Bowman et al. . | |
| 4,440,407 | 4/1984 | Gagas . | |
| 4,582,449 | 4/1986 | Vosswinkel . | |
| 4,582,450 | 4/1986 | Neil . | |
| 4,637,752 | 1/1987 | Centa . | |
| 4,747,739 | 5/1988 | Bowman et al. . | |
| 4,763,449 | 8/1988 | Vigneron et al. . | |
| 4,834,574 | 5/1989 | Bowman . | |
| 4,867,600 | 9/1989 | Bowman . | |
| 4,872,780 | 10/1989 | Bowman . | |
| 4,927,290 | 5/1990 | Bowman . | |
| 4,963,053 | 10/1990 | Bowman . | |
| 4,966,489 | 10/1990 | Bowman . | |
| 4,969,770 | 11/1990 | Bowman . | |
| 4,969,771 | 11/1990 | Bowman . | |
| 5,021,261 | 6/1991 | Bowman . | |
| 5,039,248 | 8/1991 | Bowman . | |
| 5,051,022 | 9/1991 | Bowman . | |
| 5,115,622 | 5/1992 | Ammann et al. | 52/741 |
| 5,143,478 | 9/1992 | Bowman . | |
| 5,150,984 | 9/1992 | Bowman . | |
| 5,165,819 | 11/1992 | Bowman . | |
| 5,184,912 | 2/1993 | Bowman . | |

ANCHOR FOR UTILITY ACCESS HOLE SUPPORT INSERT

This application is a continuation of application Ser. No. 08/242/015, filed May 12, 1994, now abandoned, which is a continuation-in-part of U.S. application Ser. No. 08/087,171, filed Jul. 2, 1993, now abandoned.

BACKGROUND OF THE INVENTION

1. Field of the Invention

This invention relates to manhole cover support inserts or grate support inserts for placing over and raising the effective grade of an existing manhole cover or grate receiving structure, and more particularly, to anchors for anchoring manhole cover support inserts or grate support inserts to manhole cover or grate receiving structures.

2. Description of the Related Art

Ordinarily, a manhole cover support insert or grate support insert is used when a roadway is resurfaced with an added layer of paving material. A support insert raises the level of the manhole cover or grate to the new street level. Support inserts typically occupy a seat where a manhole cover or grate was intended to rest in a utility access frame. Support inserts are available in a wide variety of shapes and sizes to accommodate the wide variety of utility access openings. Some support inserts are formed by a plurality of connectable segments, while others are of fixed dimension construction for length and width. Frequently, support inserts are anchored to the receiving structure, which is a utility access frame or manhole frame. A typical prior art anchor is simply a strap of metal which is bolted to a threaded hole in the support insert at its upper end. The lower end is angled to reach beneath a rim or flange which is formed in the utility access frame. A bolt which is threaded through the lower end of this strap contacts the underside of the rim to tighten the anchor. In other words, when the bolt is rotated, the strap is tensioned to secure the support insert to the utility access frame. A worker must hold the strap in position with one hand and thread the upper screw into the support insert with the other. Once the upper end of the strap is secured, the worker must reach inside the utility access frame opening to tension the strap by tightening a downward-facing bolt against the frame.

Another anchor device was developed by the present inventor and disclosed in U.S. patent application Ser. No. 07/986,980 titled Anchor for Manhole Cover Support filed on Dec. 8, 1992. In this development, a strap is connected to the support insert with a dovetail connection permitting the anchor to be dropped into place. A bolt is located at the opposite end of the strap for engaging the utility access frame and for tensioning the strap. A worker must reach inside the utility access hole and below street level to tighten the anchor bolt. The head of the tensioning bolt faces in a downward direction and is difficult to see and reach.

Oftentimes, parts and tools are dropped and lost due to the difficulty of installing support insert anchoring straps. There is a need for a simple, speedy positive means of connecting the anchor straps with the support insert to simplify and speed up installation and reduce the frequency of dropping parts.

SUMMARY OF THE INVENTION

Basically, the invention is an apparatus for securing a support insert to a rim of a utility access frame opening. The apparatus includes a rotatable locking member having a threaded portion, a toe portion for engaging said rim and a stop member opposite the toe portion. The apparatus includes a lock housing connected to and projecting inwardly and downwardly of the support insert. The housing has an opening for receiving the threaded portion of the lock member and for receiving a threaded shaft which is adapted to be threaded to the threaded portion. The housing also has a stop surface for engaging the stop member to stop rotation of the locking member at a predetermined position. The locking member is connected to the housing by the threaded shaft. The shaft has a head portion for permitting the shaft to be rotated. Rotation of the head portion and the shaft causes the locking member to rotate until the toe portion extends outside the perimeter of the utility access opening (as defined by the rim) to a stopping point. At the stopping point, the stop member engages the stop surface and further rotation of the shaft causes tension in the shaft thereby driving the locking member toward the rim to damp the insert to the frame.

In the preferred and illustrated embodiments the threaded shaft is the shaft of a threaded bolt and the head portion is the head of the bolt and the head of the bolt is located substantially near the rim of the utility access frame.

In the preferred and illustrated embodiments, a spring member is located between the head portion and the housing.

In the preferred and illustrated embodiments, nylon material is provided between the threads of the threaded shaft and the threaded portion of the locking member to create a resistance to rotation between the shaft and the threaded portion.

In one preferred embodiment, the locking apparatus is an integral part of a casting of a segment of a support insert.

In another preferred embodiment, the locking apparatus is a unit which is adapted to be welded to an inner surface of a support insert.

BRIEF DESCRIPTION OF THE DRAWINGS

A preferred embodiment of the invention is shown in the accompanying drawings in which.

DESCRIPTION OF THE PREFERRED EMBODIMENT

Figure 1:
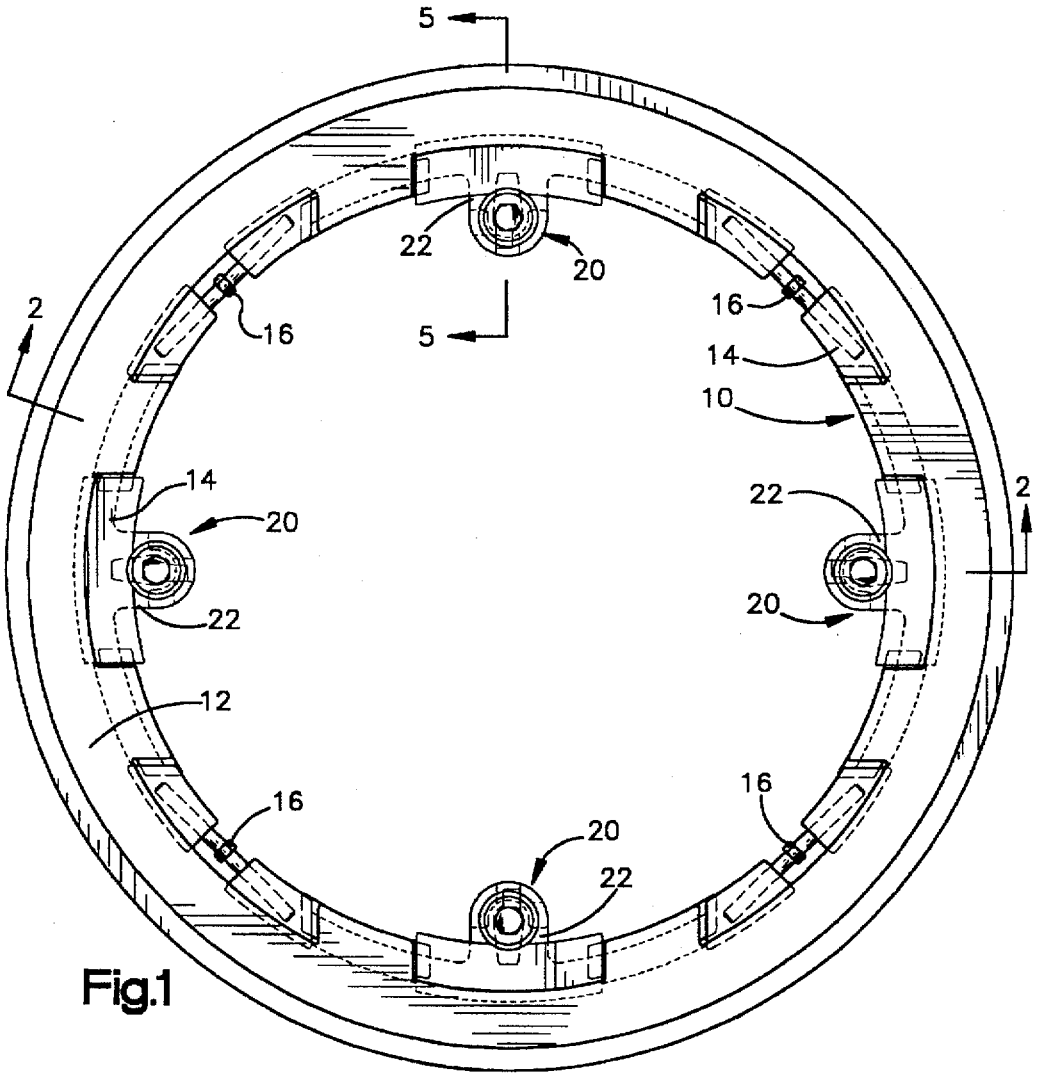
FIG. 1 is a top plan view of a manhole cover support insert and an anchoring system.
Figure 2:
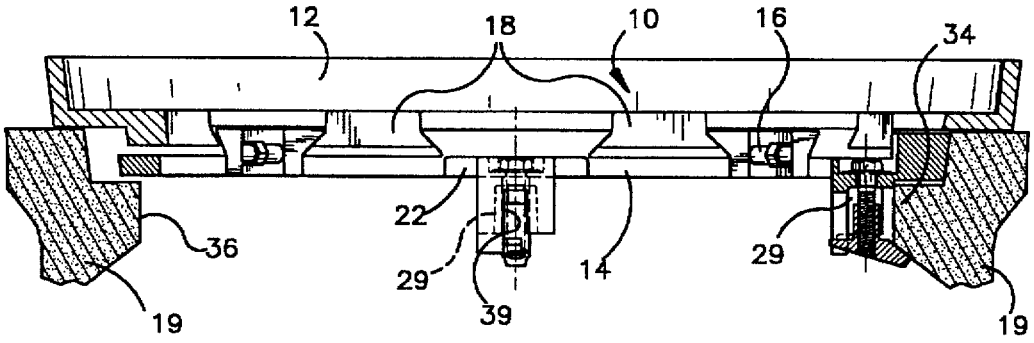
FIG. 2 is a cross-sectional view as seen approximately from the plane indicated by the line 2—2 in FIG. 1.

Referring to FIGS. 1 and 2, a segmented manhole cover support insert 10 is shown. The cover support insert 10 has an upper annular cover seat 12 which receives a manhole cover (not shown). The annular seat 12 is connected to a segmented base member 14. The diameter of the base member 14 may be adjusted with turnbuckles 16 which join the segments of the base member 14. The base member 14 and the annular seat 12 are joined by the interconnection of dovetail members 18 formed in their confronting surfaces. The base member 14 engages a utility access frame or manhole frame 19 as shown in FIG. 2.

Figure 3:
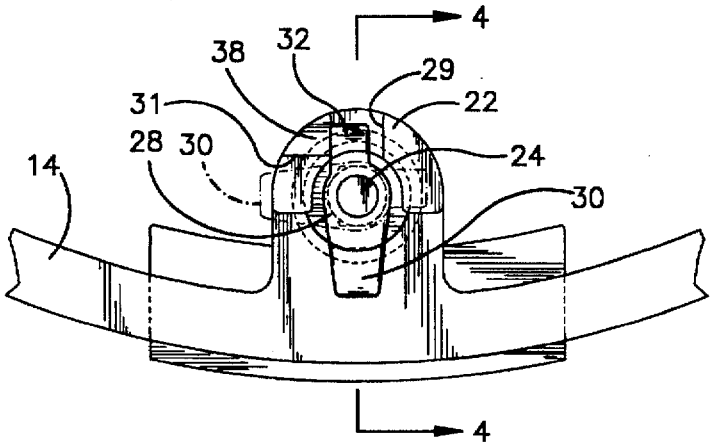
FIG. 3 is a partial bottom plan view of a single anchoring device.
Figures 4, 5:
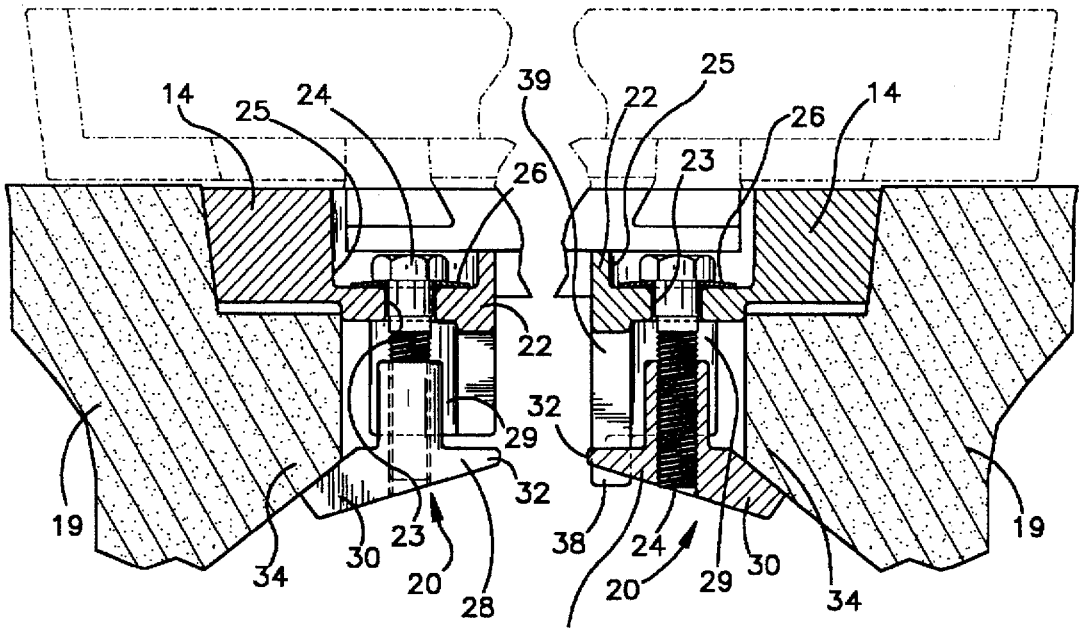
FIG. 4 is a partial cross sectional view as seen approximately from the plane as indicated by the line 4—4 of FIG. 3.
FIG. 5 is a partial cross sectional view as seen approximately from the plane indicated by the line 5—5 of FIG. 1.

Referring to FIGS. 3–5, integrally formed on each segment of the base member 14 is a locking device 20. Each locking device 20 includes a housing 22 projecting from the base member 14. A vertical bore 23 is formed in each housing 22. A threaded bolt 24 is fitted into each bore with sufficient clearance to permit the bolt 24 to rotate. A recess 25 is formed at the top of each housing 22 to accommodate the heads of the bolts 24. A lock washer or Belleville-type spring disk 26 is placed between the head of the bolt 24 and the bottom of the recess 25 to resist loosening of the bolt 24 once it is tightened. To the end of each bolt 24 is threaded a locking member 28. The top of each housing 22 is low enough on the insert 10 to avoid interference with a manhole cover.

Each locking member 28 has a threaded portion 29 and a toe member 30 extending radially outward from the sleeve 29. The sleeve has a threaded bore sized to fit the threaded shaft of the bolt 24. A projection 32 extends from the locking member 28 opposite to the toe member 30. The toe member 30 is shaped to engage and cooperate with a rim 34 formed about a utility access openings or manhole 36 as seen in FIG. 2.

Each housing 22 includes an opening 29 coaxial with the bore 23 for receiving the threaded shaft of one of the bolts 24 and a portion of one of the locking members 28. The projection 32 of the locking member 28 is arranged to engage a stop surface 38 which is the edge of a slot 39 extending vertically through the wall of the housing 22 as best seen in FIGS. 2, 4 and 5. The housings 22 not only provide stop surfaces for the locking members 28, but also serve to protect the threads of the bolts 24 and the locking members 28 themselves from damage caused by pry bars and other tools used around manholes. The housing 22 also includes a second stop surface 31 for stopping the clockwise rotation of the locking member 28 (as viewed in FIG. 3) in a neutral position. When the lock members 28 are in their neutral position as seen in broken lines in FIG. 3, the insert 10 may be placed inside the manhole frame 19 without interference.

Figure 8A:
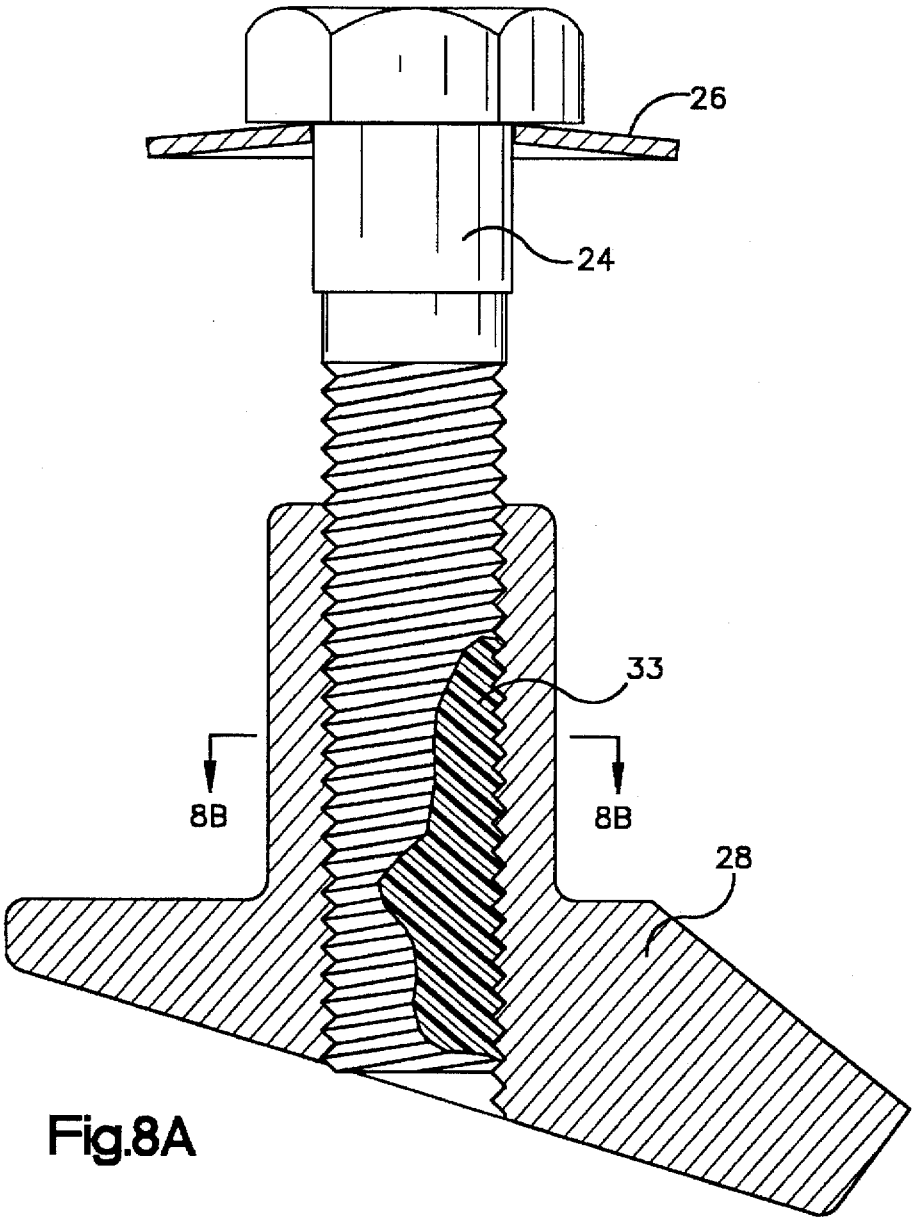
FIG. 8A is a side elevational view of an assembly including a locking member and a bolt with part of the locking member cut away.
Figure 8B:
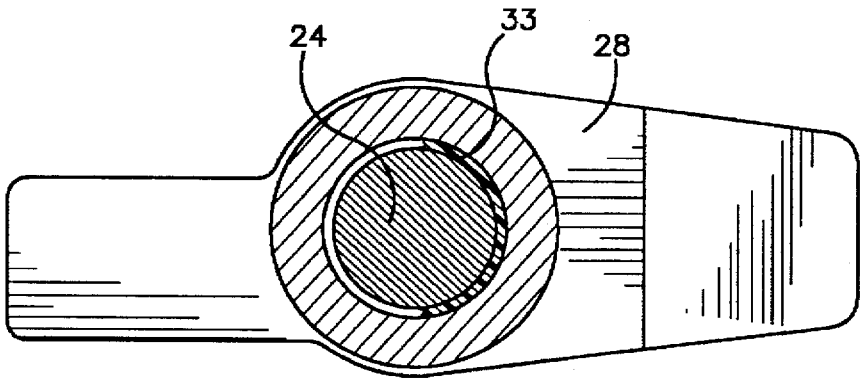
FIG. 8B is a cross sectional view of the assembly of FIG. 8A as seen approximately from the plane indicated by the line 8B—8B of FIG. 8A.
Figure 9:
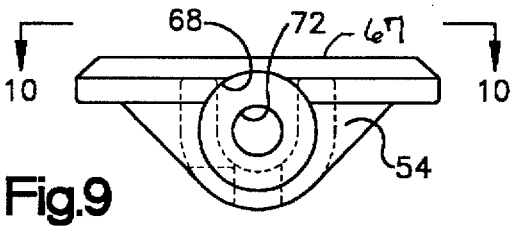
FIG. 9 is a top plan view of an alternative embodiment showing a unitary member.
Figure 10:
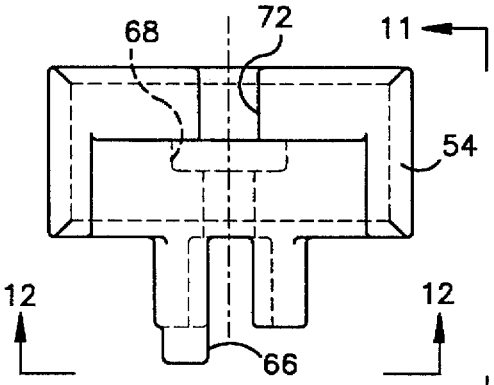
FIG. 10 is an elevational view of the member of FIG. 9 as seen approximately from the plane indicated by the line 10—10 of FIG. 9.
Figure 11:
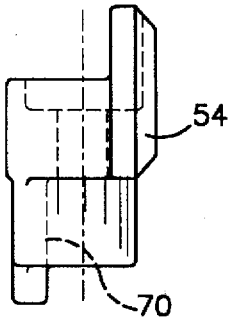
FIG. 11 is a side elevational view of the lock housing of FIG. 8 as seen approximately from the plane indicated by the line 11—11 of FIG. 10.
Figure 12:
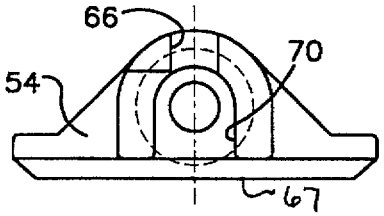
FIG. 12 is a bottom plan view of the lock housing of FIG. 8 as seen approximately from the plane indicated by line 12—12 of FIG. 10.
Figure 13:
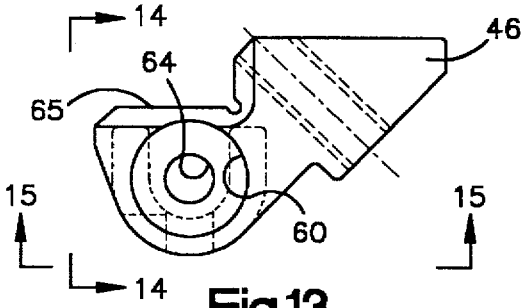
FIG. 13 is a top plan view of another lock housing embodiment.
Figure 14:
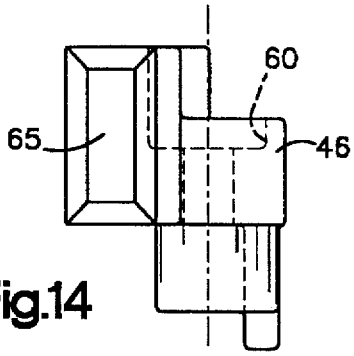
FIG. 14 is a side elevational view of the lock housing of FIG. 13 as seen approximately from the plane indicated by the line 14—14 of FIG. 13.
Figure 15:
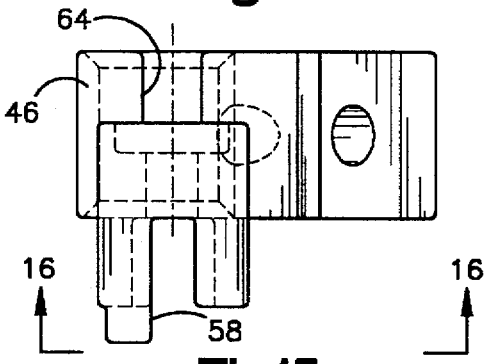
FIG. 15 is a front elevational view of the lock housing of FIG. 13 as seen approximately from the plane indicated by the line 15—15 of FIG. 13.
Figure 16:
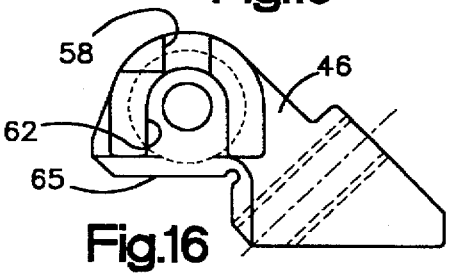
FIG. 16 is a bottom plan view of the lock housing of FIG. 13 as seen approximately from the plane indicated by the line 16—16 of FIG. 15.

Referring to FIGS. 8A and 8B, a patch of nylon material 33 is applied to the threaded portion of each bolt 24 to increase the friction between the bolt threads and the locking member 28. The nylon material 33, which is commercially available from a company called ND Industries, is preferably sprayed on the bolt threads as a liquid which later dries to a solid. The nylon material 33 helps ensure that rotation of the bolt 24 will rotate the locking member 28 until it is in the proper position to be tightened against the rim 34. Too little friction between these parts could result in the tightening of the locking members 28 before they are outwardly rotated beneath the rim 34.

If a locking member 28 is in its inner neutral position, which is inside the perimeter of the access hole 36 as shown in broken lines in FIG. 3, rotation of the bolt 24 in a counterclockwise direction (as viewed in the direction of FIG. 3) will cause the me member 28 to rotate counterclockwise into its outer locking position where the toe portion 30 extends outside the perimeter of the access hole 36 (as seen in solid lines in FIG. 3). The rotation of the locking member 28 will stop when the projection 32 engages the stop member 38. Further rotation of the bolt 24 will cause the locking member 28 to move axially along the bolt 24 due to the relative motion of the threads formed on the outside of the bolt 24 and the inside of the sleeve 29. Tightening of the bolt 24 eventually causes the toe member 30 to engage the lower surface of the rim 34 which locks the support insert 10 to the frame 19. Rotation of the bolt 24 in the opposite direction when the cover support insert 10 is locked to the frame 19 causes the locking member 28 to move downward until it is free from the rim 34. Without the frictional drag of engagement with the rim 34, the locking member 28 will rotate inward (clockwise as viewed in FIG. 3) until it has again reached the neutral position inside the perimeter of the manhole 36 as shown in FIG. 3 in broken lines.

To install the manhole cover support insert 10, the locking members 28 are first rotated inward to the broken-line position of FIG. 3. Then, the cover support insert 10 is aligned with the manhole 36 and rested on the frame 19 such that the base 14 engages the edges of the access hole 36 as shown in FIG. 2. Then, a worker rotates the heads of the bolts 24 clockwise (as viewed in FIG. 1) to move the locking members 28 into locking position. The bolts 24 are further rotated to raise each locking member 28 into engagement with the underside of the rim 34 and to compress each Belleville spring 26. The rotation of the bolts 24 is done with full visibility of the head of the bolts 24 and without having to reach inside the utility access hole.

In another preferred embodiment shown in FIGS. 6–15, an adjustable insert 40 for raising the grade of a rectangular grating (not shown) that resides in a catch basin frame 42 or in a similar utility access frame includes a similar locking arrangement. The insert 40 is similar to that disclosed in U.S. Pat. No. 5,039,248 titled Support for Catch Basin Cover, which is incorporated herein by reference.

Figure 7:
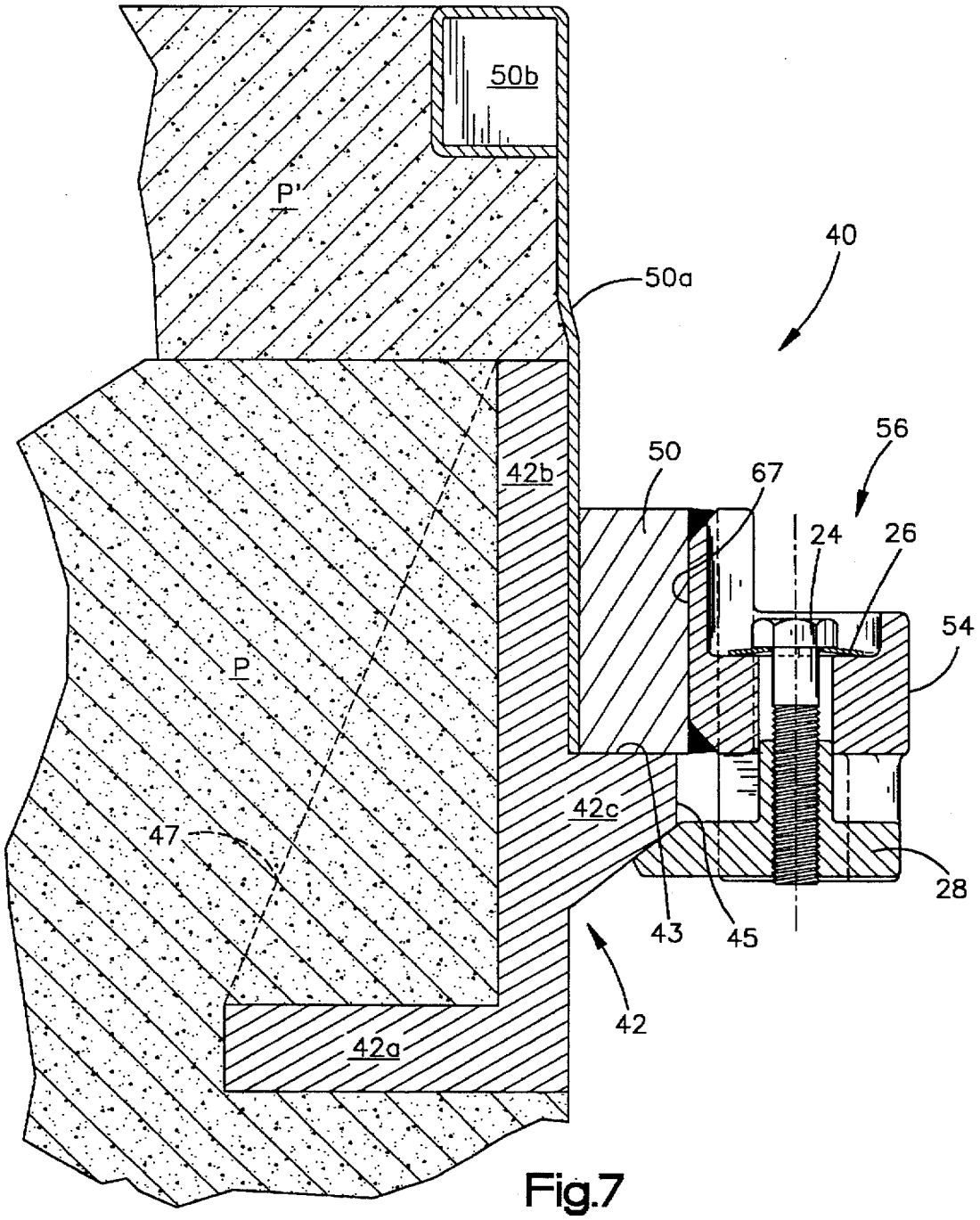
FIG. 7 is a cross sectional view as seen approximately from the plane indicated by the line 7—7 of FIG. 6.

As shown best in FIG. 7, the catch basin frame 42 is anchored by material P from which the roadway is constructed, i.e., concrete, asphalt, etc. A typical catch basin frame 42 that is installed during initial construction of the roadway, includes an outwardly extending radial flange 42*a* and an upwardly extending vertical wall 42*b*. Extending radially inwardly from the vertical wall 42b is a ledge 42c which defines a seating or rim support surface 43 upon which the original grade cover (not shown) sits. An end wall 45 defines the access opening for the catch basin. The original catch basin frame may include gussets 47 for providing added structural strength or rigidity.

When a roadway is resurfaced, a layer of additional paving material P' is laid atop the original roadway. As a result, the overall level or grade of the roadway is raised. In order for the original catch basin cover (not shown) to be flush with the new roadway level, either a new catch basin frame must be installed or the searing or rim support surface for the catch basin frame must be raised.

Figure 6:
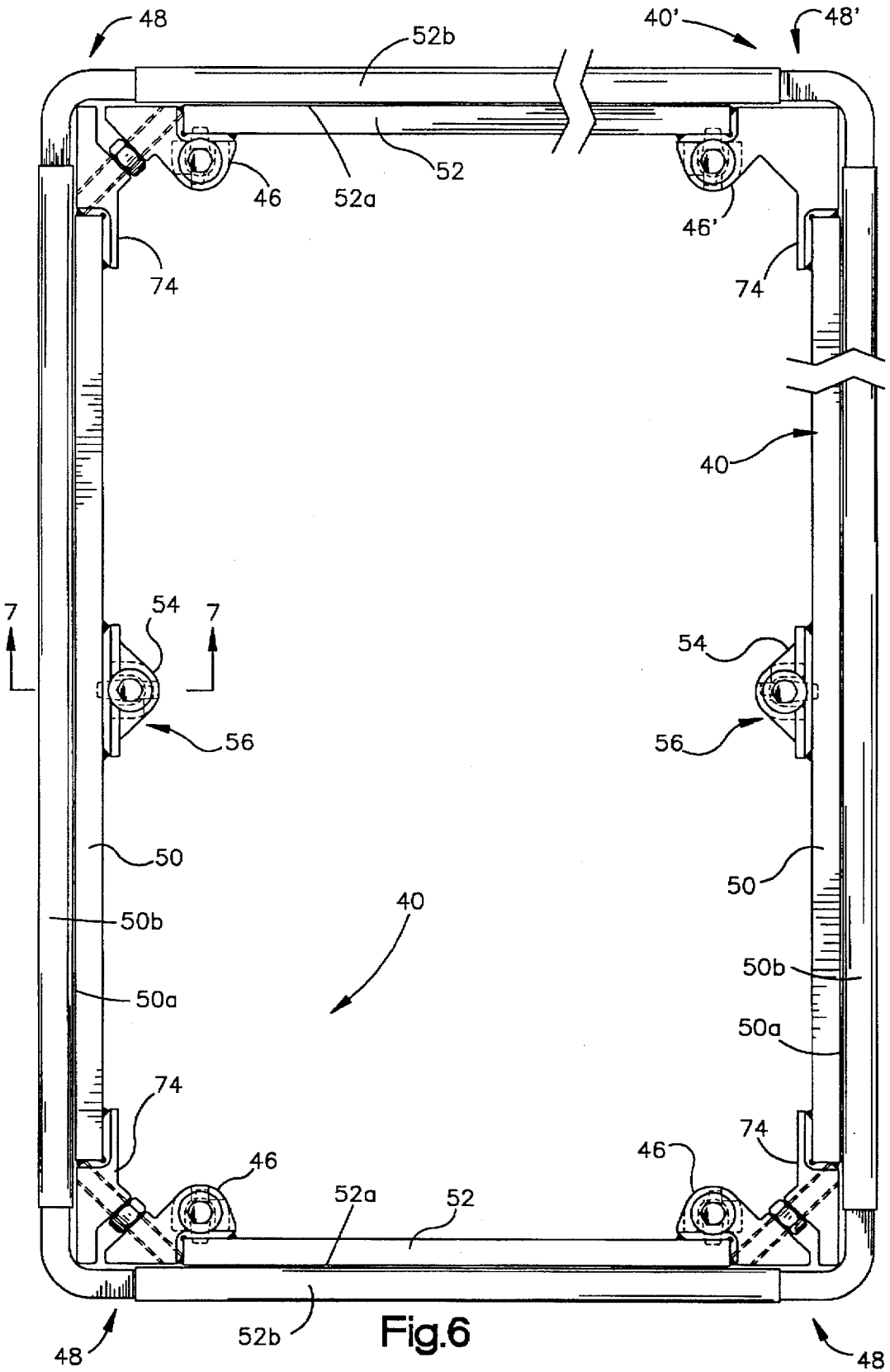
FIG. 6 is a top fragmentary, plan view of an adjustable and a fixed grate support insert including the anchoring system.

The insert 40 illustrated in FIGS. 6 and 7 provides a means for effectively raising the seat for the original catch basin cover. As seen best in FIG. 6, the insert 40 includes interconnected side bars 50 and end bars 52. Referring also to FIG. 7, extending upwardly from the side bars and end bars are thin walled keepers 50a, 52b.

Extending radially outwardly from an upper part of the thin wall keepers 50a, 52a are respective reinforcing sections 50b, 52i which, for purposes of explanation are termed "wales". For an in depth discussion of the purposes and advantages of using wales as part of thin wall keepers, reference should be made to reissue Patent No. RE 34,550 which is hereby incorporated by reference.

The outside of the keeper walls which extend above the original roadway material P, are contained and supported by the new roadway material P'. With the disclosed insert, the original catch basin frame need not be modified or re-worked and the original catch basin cover may be utilized to cap the opening after the new roadway is completed.

In the preferred and illustrated embodiment, the insert 40 includes locking apparatus similar to that described above to mount and lock the insert to the ledge 42c of the original catch basin cover. Specifically, a housing 46 of a locking apparatus like that described in connection with FIGS. 1–5 is integrally cast into corner members 48 which, are welded to the side bars 50 and/or end bars 52 to form the insert 40.

Additionally, lock housings 54 are designed to be integrally cast into unitary members 56, which are adapted to be welded to the inside surfaces of the side bars 50 forming the insert 40. Each corner member 48 has an L-shaped portion 65 for receiving a squared end of a bar 52. Each bar 52 is welded to the L-shaped portion 65 as shown in FIG. 6. Each unitary member 56 has a flat surface 67 for abutting against the side bars 50 and for forming a welded connection with one of the bars 50 as shown in FIG. 6. The unitary members 56 are positioned at a predetermined location on the bars 52 such that the top of the housing 54 will not interfere with a grate or cover (not shown) resting on the insert 40.

Both the lock housing 46 of the corner members 48 and the lock housing 54 of the unitary members 56 are adapted to receive the bolt 24, spring 26, and locking member 28 described above to form locking assemblies for locking the insert 40 to the frame 42. The housings 46, 54 of the corner and unitary members 48, 56 are essentially the same as the housing 22 previously described. The housing 46 includes a stop surface 58, a recess 60, an opening 62, and a bore 64. Similarly, the housing 54 includes a stop surface 66, a recess 68, an opening 70 and a bore 72. Though not illustrated, a lock housing may also be integrally cast into an end support 74.

A portion of FIG. 6 illustrates another slightly modified embodiment of the invention. The upper right corner of the insert shown in FIG. 6 illustrates a non-adjustable version 40' of the insert. In this embodiment, fixed non-adjustable corner members 48' are used. The corner member 48' is welded to both the side bars 50 and the end bars 52. The lock housing 46' and associated components, however, are substantially identical to the components shown in FIGS. 8–15 and described above.

While preferred embodiments of this invention have been described in detail, it will be apparent that certain modifications or alterations can be made without departing from the spirit and scope of the invention set forth in the appended claims.

I claim:

1. A manhole assembly comprising:

an insert for supporting a manhole cover;

a rotatable locking member having a toe portion adapted to engage a rim of a utility access frame and a threaded portion defining a hole therein;

a housing connected to and projected downwardly from the support insert, said housing having an opening therein;

a threaded shaft located in said housing opening and being threaded to the threaded portion of said locking member, said shaft having a head portion for permitting said shaft to be rotated; and a stop surface for stopping rotation of said locking member at a predetermined position; said stop surface being located on said housing;

wherein rotation of said shaft head portion causes said locking member to rotate until said toe portion extends below such rim to a stopping point where said locking member engages said stop surface, and further rotation of said shaft drives said locking member toward such rim to clamp the insert to such frame.

2. An apparatus according to claim 1 wherein a spring member is located between said head portion and said housing.

3. An apparatus according to claim 1 wherein thermoplastic material is disposed between threads of said threaded shaft and the threaded portion of said locking member to create a resistance to rotation between said shaft and said locking member.

4. A manhole assembly according to claim 1 wherein said insert comprises at least one adjustable member for increasing and decreasing the peripheral dimensions of said insert.

5. A manhole assembly comprising:

a manhole assembly component a portion of which extends in a first direction;

a locking member having a threaded portion that defines an opening through said locking member, said locking member being adapted to engage a rim of a utility access frame;

a shaft having a threaded portion adapted to engage the locking member threaded portion and a head portion permitting the shaft to be rotated, wherein said shaft can extend through an opening in said component;

a housing connected to said portion of said component and having first and second housing portions extending from the housing defining a channel therebetween, said first and second housing portions extending in a second direction, and means for stopping the rotation of said locking member consisting of a single stop member extending from an end portion of one of said housing portions, wherein rotation of said shaft rotates said locking member until said locking member engages said stop member, and further rotation of said shaft drives said locking member into the channel toward the housing to clamp said component to such frame.

6. A manhole assembly according to claim 5, said component comprising a support insert for supporting a manhole cover, wherein said housing is an integral part of a casting of a segment of the support insert.

7. An assembly according to claim 5 wherein thermoplastic material is disposed between the threads of said threaded portion of the shaft and the threads of the threaded portion of said locking member to create a resistance to rotation between said shaft and said locking member.

8. An assembly according to claim 5 wherein said locking member can engage said stop member when it is in a locking position to clamp such utility access frame and when it is in a neutral position in which it cannot clamp such utility access frame.

9. An assembly according to claim 5 wherein said stop member includes two stop surfaces for stopping the rotation of said locking member.

10. A manhole assembly according to claim 5 wherein said manhole assembly component comprises at least one adjustable member for increasing and decreasing the peripheral dimensions of said manhole assembly component.

11. A manhole assembly comprising:

an insert for supporting a manhole cover;

a rotatable locking member having a toe portion adapted to engage a rim of a utility access frame and a threaded portion defining a hole therein;

a housing connected to and projected downwardly from the support insert, said housing having an opening therein;

a threaded shaft located in said housing opening and being threaded to the threaded portion of said locking member, said shaft having a head portion for permitting said shaft to be rotated, wherein said housing defines a downwardly extending rectilinear slot and the toe portion when in said slot is constrained in a locking position in which said locking member extends below such rim; and a stop surface for stopping rotation of said locking member at a predetermined position;

wherein rotation of said shaft head portion causes said locking member to rotate until said toe portion extends below such rim to a stopping point where said locking member engages said stop surface, and further rotation of said shaft drives said locking member toward such rim to clamp the insert to such frame.

12. A manhole assembly according to claim 11 wherein said insert comprises at least one adjustable member for increasing and decreasing the peripheral dimensions of said insert.

13. An apparatus for clamping to the rim of a utility access frame, comprising:

a rotatable locking member having a toe portion adapted to engage the rim of such a utility access frame, said rotatable locking member having a threaded portion defining a hole therein;

a shaft having a threaded portion threaded to the threaded portion of said locking member, said shaft having a head portion adapted to permit said shaft to be rotated to cause said toe portion to engage the rim;

a stop surface adjacent to said rotatable locking member for stopping rotation of said locking member at a predetermined position; and a thermoplastic material disposed between the threads of the threaded portion of said shaft and the threads of the threaded portion of said locking member, wherein said thermoplastic material creates a resistance sufficient to overcome rotation between said shaft and said locking member until rotation of the locking member is stopped at said predetermined position by said stop surface, said thermoplastic material being adapted to permit said shaft to be rotated after said locking member contacts said stop surface;

wherein rotation of said shaft head portion causes said locking member to rotate until said toe portion extends below such rim to said predetermined position where said locking member engages said stop surface, and wherein further rotation of said shaft drives said locking member toward such rim to clamp the apparatus to such a utility access frame.

14. The apparatus of claim 13 wherein said thermoplastic material extends around substantially an entire circumference of the threaded portion of the shaft for substantially an entire length of the threaded portion of the shaft.

15. An apparatus for clamping to the rim of a utility access frame comprising:

a rotatable locking member having a toe portion adapted to engage such a rim of a utility access frame and a threaded portion defining a hole therein;

a housing adapted to be connected to and projected downwardly below a support insert disposed on such a utility access frame;

a threaded shaft located in an opening of the housing and threaded to the threaded portion of said locking member, said shaft having a head portion for permitting said shaft to be rotated; and a stop surface for stopping rotation of said locking member at a predetermined position, said stop surface being disposed on said housing;

wherein rotation of said shaft head portion causes said locking member to rotate until said toe portion extends below such rim to a stopping point where said locking member engages said stop surface, and further rotation of said shaft drives said locking member toward such rim to clamp the apparatus to such a utility access frame.

* * * * *